US007641361B2

(12) United States Patent
Wedell et al.

(10) Patent No.: US 7,641,361 B2
(45) Date of Patent: Jan. 5, 2010

(54) LIGHT EMITTING DIODE LAMP

(75) Inventors: Mark Taylor Wedell, Wilmington, NC (US); Michael Scott Tau, Charlotte, NC (US)

(73) Assignee: Brasstech, Inc., Santa Ana, CA (US)

( * ) Notice: Subject to any disclaimer, the term of this patent is extended or adjusted under 35 U.S.C. 154(b) by 0 days.

(21) Appl. No.: 11/752,943

(22) Filed: May 24, 2007

(65) Prior Publication Data

US 2008/0291663 A1 Nov. 27, 2008

(51) Int. Cl.
*F21V 11/00* (2006.01)

(52) U.S. Cl. ..... 362/240; 362/249.02; 362/800

(58) Field of Classification Search ..... 362/240, 362/244, 246, 249, 252, 237, 294, 326, 555, 362/800, 249.02
See application file for complete search history.

(56) References Cited

U.S. PATENT DOCUMENTS 4,054,792 A * 10/1977 Brudy ..... 362/267
4,783,726 A * 11/1988 Wang ..... 362/252
5,272,603 A 12/1993 Camarota et al.
5,422,801 A * 6/1995 Sangalli, Jr. ..... 362/252
5,561,346 A * 10/1996 Byrne ..... 313/512
5,567,036 A * 10/1996 Theobald et al. ..... 362/485
5,791,775 A 8/1998 Douglass, II
5,806,965 A * 9/1998 Deese ..... 362/249
5,929,788 A * 7/1999 Vukosic ..... 340/908.1
5,947,588 A 9/1999 Huang
5,997,151 A 12/1999 Douglass, II
6,149,283 A 11/2000 Conway et al.
6,158,882 A 12/2000 Bischoff, Jr.
6,220,722 B1 * 4/2001 Begemann ..... 362/231
6,250,774 B1 6/2001 Begemann et al.
6,257,737 B1 7/2001 Marshall et al.
6,361,190 B1 3/2002 McDermott
6,425,678 B1 * 7/2002 Verdes et al. ..... 362/244
6,452,217 B1 * 9/2002 Wojnarowski et al. ..... 257/99
6,461,008 B1 * 10/2002 Pederson ..... 362/35
6,483,254 B2 * 11/2002 Vo et al. ..... 315/241 S
6,483,439 B1 * 11/2002 Vukosic ..... 340/815.65
6,517,217 B1 * 2/2003 Liao ..... 362/235
6,525,668 B1 * 2/2003 Petrick ..... 340/815.45
6,557,072 B2 4/2003 Osborn
6,580,228 B1 6/2003 Chen et al.
6,598,996 B1 * 7/2003 Lodhie ..... 362/249
6,626,557 B1 * 9/2003 Taylor ..... 362/249
6,634,771 B2 * 10/2003 Cao ..... 362/294
6,752,523 B2 * 6/2004 Takahashi ..... 362/545
6,857,756 B2 * 2/2005 Reiff et al. ..... 362/184
6,860,628 B2 3/2005 Robertson et al.
6,948,829 B2 9/2005 Verdes et al.
6,953,401 B2 10/2005 Starr
7,014,337 B2 * 3/2006 Chen ..... 362/240
7,036,961 B2 5/2006 Defouw et al.
7,052,157 B1 5/2006 Lau (Continued)

*Primary Examiner*—Gunyoung T Lee
(74) *Attorney, Agent, or Firm*—Carlson, Gaskey & Olds

(57) ABSTRACT

An example light emitting diode bulb assembly includes a base having a first end portion and a second end portion defining an axis, a plurality of first light emitting diodes secured adjacent a plurality of first base surfaces about the axis, and at least one second light emitting diode secured adjacent a second base surface of the first end portion, wherein the second base surface is transverse to the plurality of first base surfaces.

8 Claims, 4 Drawing Sheets

U.S. PATENT DOCUMENTS 7,086,756 B2 8/2006 Maxik
7,102,172 B2 9/2006 Lynch et al.
7,114,830 B2 10/2006 Robertson et al.
7,158,019 B2 * 1/2007 Smith ..... 340/467
7,172,314 B2 2/2007 Currie et al.
7,327,254 B2 * 2/2008 Chen ..... 340/545.2
2004/0114367 A1 * 6/2004 Li ..... 362/248
2006/0274529 A1 12/2006 Cao
2007/0047243 A1 3/2007 Hacker et al.

* cited by examiner

LIGHT EMITTING DIODE LAMP

BACKGROUND OF THE INVENTION

This invention generally relates to a lamp having a bulb that includes a plurality of light emitting diodes.

A light emitting diode (LED) is a known type of light emitting semi-conductor device. The emitted light may change color and intensity depending on the type of semi-conductor material. LED based lighting is typically more efficient than conventional lighting systems, such as a system utilizing an incandescent light bulb.

Incandescent light bulbs have a relatively short life span. Typically, the incandescent light bulb engages a threaded socket within an incandescent lamp. The conventional lighting system design must provide access for replacing the incandescent light bulb and must further accommodate the threaded socket. Thus, the conventional lighting system has limited design options. LED based lighting provides greater design freedom due in part to the efficiency and relatively small size of the LED.

Even though some recently developed types of LED generate more light than previous LED types, at least one LED is still typically required to generate to same amount of light as the incandescent light bulb. Distributing the light from more than one LED to mimic a traditional incandescent lighting pattern is often difficult as more than one LED may result in visible lighting "hot-spots" for example. LED based lighting also generates more thermal energy per watt than conventional lighting, which can overheat the system. Accordingly, previous attempts to replace conventional incandescent light bulbs with LED based lighting have proven ineffective.

SUMMARY OF THE INVENTION

An example light emitting diode bulb assembly includes a base having a first end portion and a second end portion defining an axis, a plurality of first light emitting diodes secured adjacent a plurality of first base surfaces about the axis, and at least one second light emitting diode secured adjacent a second base surface of the first end portion, wherein the second base surface is transverse to the plurality of first base surfaces.

An example light emitting diode lamp assembly includes a lamp fixture and a first bulb assembly. The first bulb assembly includes a bulb base having a first end and a second end defining an axis, a plurality of first light emitting diodes secured to the bulb base about the axis, and at least one second light emitting diode secured adjacent the first end.

The example bulb assembly may be extruded and may include aluminum. The base typically has a rectangular cross section. The bulb assembly may include at least one channel in the base. The channel is for communicating thermal energy between the first end portion and the second end portion. The channel may be located in an interior portion of the base. The first light emitting diodes and the second light emitting diode typically mount to a plurality of circuit boards.

BRIEF DESCRIPTION OF THE DRAWINGS

These and other features of the present invention can be best understood from the following specification and drawings, the following of which is a brief description.

DETAILED DESCRIPTION OF THE PREFERRED EMBODIMENT

Figure 1:
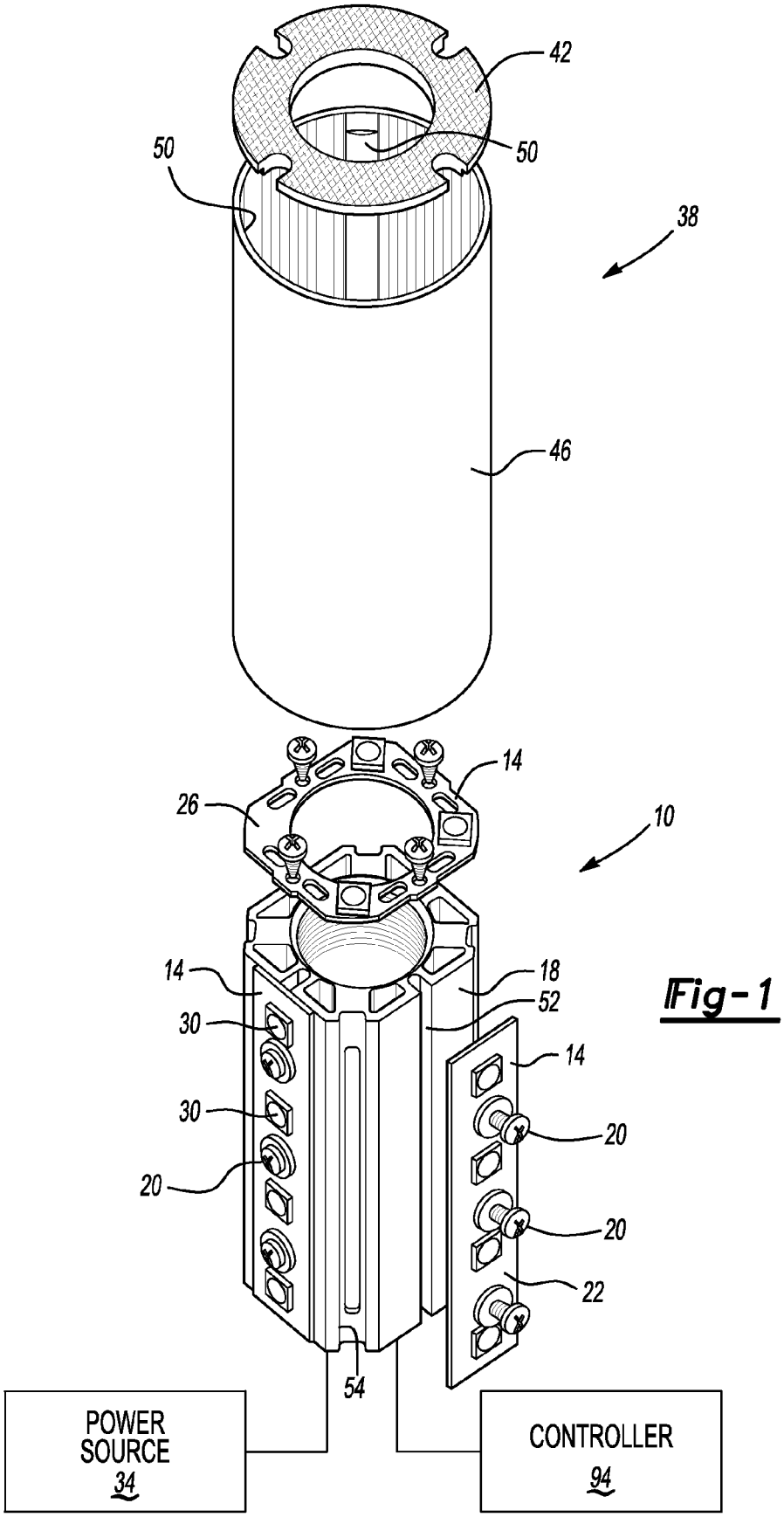
FIG. 1 illustrates a partially exploded view of an example LED bulb assembly.

A bulb assembly 10 includes a plurality of circuit boards 14 and a base 18, as shown in FIG. 1. Fasteners 20 secure the circuit boards 14 to the base 18. The circuit boards 14 include a plurality of side circuit boards 22 and a top circuit board 26. Each of the circuit boards 14 includes at least one Light Emitting Diode (LED) 30. The bulb assembly 10 connects to a power source 34, which powers the circuit boards 14 and the at least one LED 30 in a known manner.

A lens 38 fits over the base 18. The lens 38 includes a top lens portion 42 and a side lens portion 46. Ribs 50 on the interior of the side lens portion 46 engage corner grooves 54 on the base 18 to secure the lens 38 relative to the base 18. In this example, the corner grooves 54 slideably receive the ribs 50.

Figure 2:
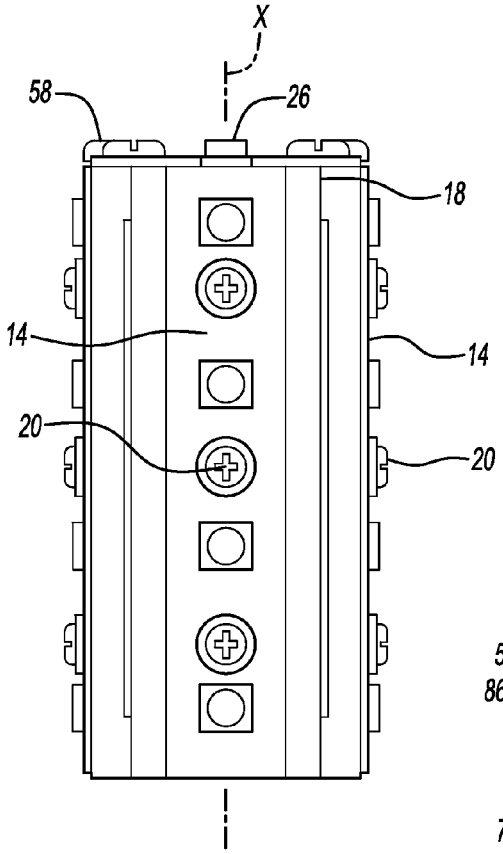
FIG. 2 illustrates a side view of the bulb assembly of FIG. 1 with a lens portion removed.

The base 18 includes a top base portion 58 and a bottom base portion 62, which define an axis X extending the length of the base 18 as shown in the FIG. 2 side view. The fasteners 20 secure the side circuit boards 22 to surfaces of the base 18 about the axis X while the top circuit board 26 secures to a surface of the top base portion 58. The side circuit boards 22 in this example each include four of the at least one LED 30, and the top circuit board 26 includes three of the at least one LED 30 (FIG. 1).

The top circuit board 26 is arranged transverse to the side circuit boards 22. Although shown in this example as a substantially perpendicular arrangement, other arrangements are possible. The top circuit board 26 may be arranged at a 45 degree angle to the side circuit boards 22 for example. Other examples may include more than one top circuit board 26.

Figure 3:
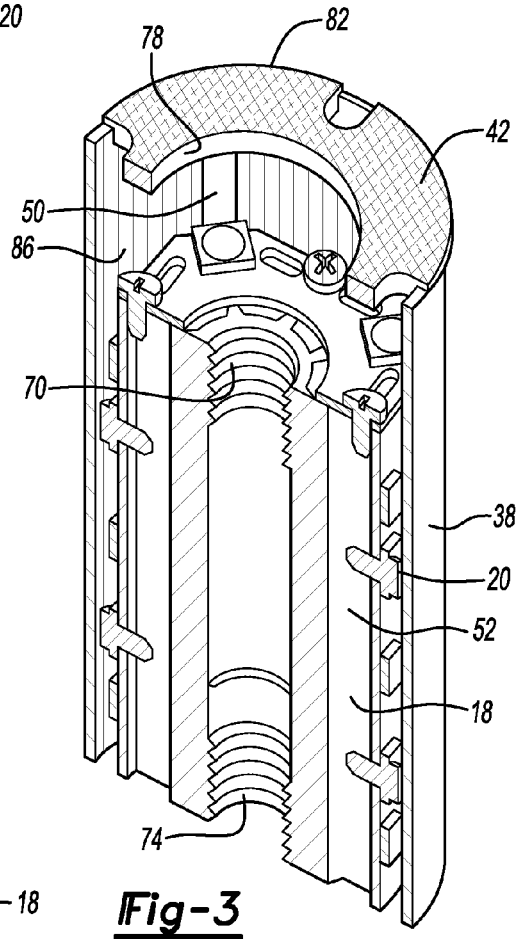
FIG. 3 illustrates a cutaway view of the bulb assembly of FIG. 1 partially received within the lens portion.

The cross-sectional view of FIG. 3 illustrates the fasteners 20 engaging a plurality of side groves 52 on the base 18. Also shown is a top threaded portion 70 and a bottom threaded portion 74, which provide engagement features adjacent the top base portion 58 and the bottom base portion 62. The top threaded portion 70 and the bottom threaded portion 74 may each connect to another bulb assembly, a lamp shade or a similar threaded accessory. A person skilled in the art and having the benefit of this disclosure would be able to develop threaded or similar attachments for joining the top threaded portion 70 and the bottom threaded portion 74 to an adjacent accessory or the threaded portion of another bulb assembly.

The top lens portion 42 of the lens 38 includes a lens opening 78 permitting access to the top threaded portion 70 through the top lens portion 42. In this example, the top lens portion 42 includes grid texture 82 while the side lens portion includes a plurality of prismatic flutes 86. The grid texture 82 and the prismatic flutes 86 may alter the light pattern from the LED 30 as the light passes through the lens 38. The grid texture 82 and the prismatic flutes 86 may be modified to redistribute light from the LED 30 to mimic light patterns of common light bulbs, such as A-bulb incandescent light. The grid texture 82 and the prismatic flutes 86 distribute the LED light so that lighting hot-spots are not easily perceived when viewing the bulb assembly 10.

Figure 4:
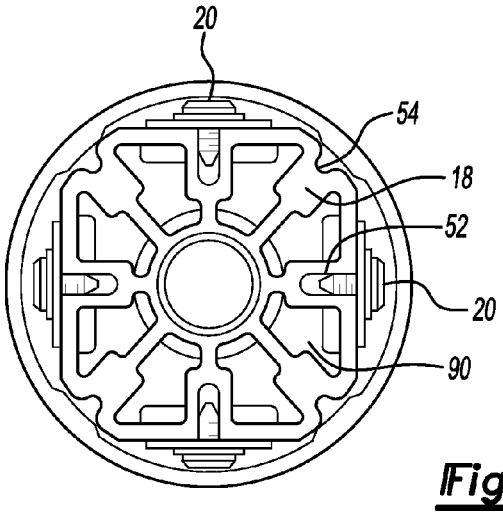
FIG. 4 illustrates a bottom view of the bulb assembly of FIG. 1.

The circuit boards 14 generate thermal energy when powering the LED 30, which may overheat the circuit boards 14. The base 18 in this example is a metal base such as aluminum, which conducts thermal energy from the circuit boards 14. The interior of the base 18 includes channels 90 and has a generally rectangular cross-section as shown in the bottom view of FIG. 4. The channels 90 extend between the bottom base portion 62 to the top base portion 58 and are substantially aligned with the axis X.

The channels 90 provide a path for thermal energy to move through the base 18. Typically, thermal energy moves from circuit boards 14, through the base 18, and to the space within the channels 90. The thermal energy next moves from the bottom of base portion 62 to the top base portion 58. After exiting the channel 90 near the top base portion 58, thermal energy moves through the lens opening 78 and escapes into the surrounding environment.

In this example, the base 18 is an extruded base, which facilitates forming the side grooves 52, the corner grooves 54, and the channels 90. Adjusting the extrusion operation changes the overall length of the base 18. The side grooves 52 provide fastening location for the fastener 20 to secure the circuit boards 14 to the base 18. Accordingly, no secondary operation, such as drilling holes, etc., is needed to provide an attachment location for the fasteners 20. The corner grooves 54 provide recessed areas for receiving the ribs 50 on the interior of the side lens portion 46 (FIG. 1).

A controller 94 may connect to the bulb assembly 10. As known, controllers 94 could be used to change the lighting intensity and patterns of the at least one LED 30. In this example, the controller 94 may provide dimming capability to the at least one LED 30 by intensifying or reducing the intensity of the at least one LED 30 within the respective circuit boards 14. In another example, the circuit boards 14 include at least one multiple colored LED 30. The controller 94 adjusts the color of light from the bulb assembly 10 by changing the intensity of the lighted LED 30 or the number and arrangement of the lighted LED 30*s*. The controller 94 may include a switch, such as a standard wall switch, a dimmer switch, a three-position switch, a low voltage switch, an RF switches, or a touch style switch.

Figure 5:
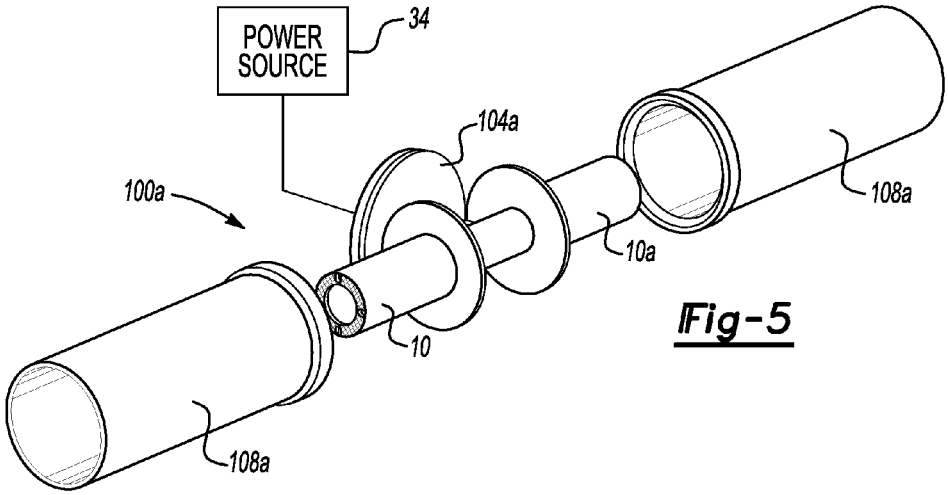
FIG. 5 illustrates an example LED lamp assembly.

A lamp assembly 100*a* may include the bulb assembly 10 and a second bulb assembly 10*a*, as shown in the example lamp assembly 100*a* of FIG. 5. The lamp assembly 100*a* is a horizontal sconce lamp for illuminating an area within a home, such as a bathroom, hallway, or other residential area, for example. Each bulb assembly 10, 10*a* attaches to a fixture 104*a* that connects to a power source 34. At least one shade attachment 108*a* fits over each bulb assembly 10, 10*a* to provide a decorative accessory and further distribute light from the bulb assembly 10. As each bulb assembly 10, 10*a* generates light using the at least one LED 30, the lamp assembly 100*a* has a longer useable life prior to replacing the lighting source than incandescent bulb based light sources. In one example, if either bulb assembly 10, 10*a* fails, a user purchases another lamp assembly 100*a* rather than replace the bulb assembly 10, 10*a*.

Figure 6:
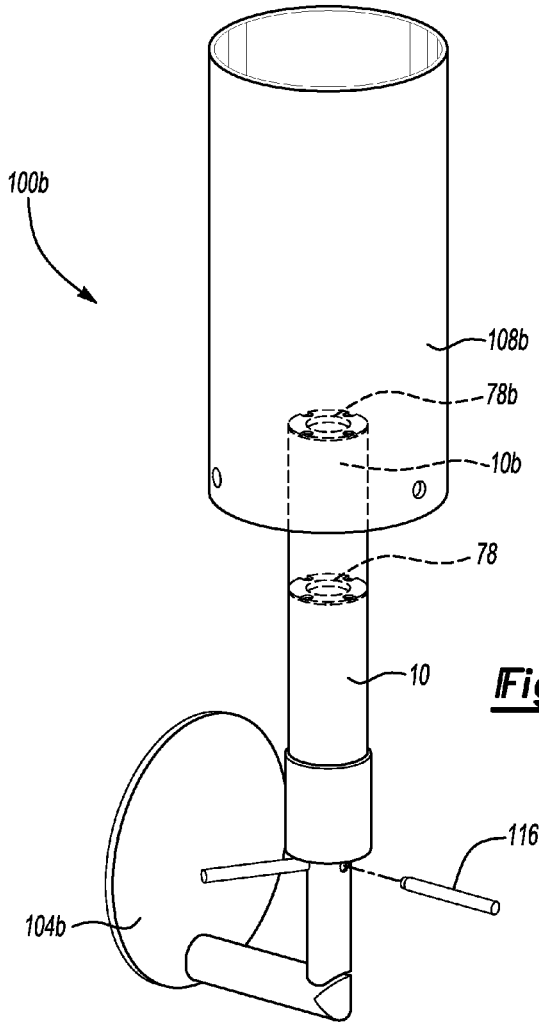
FIG. 6 illustrates another example LED lamp assembly.

Another example lamp assembly 100*b* is the vertical wall sconce of FIG. 6. The lamp assembly 100*b* includes a second bulb 10*b* that secures to the bulb assembly 10 through the lens opening 78. The second bulb 10*b* includes a threaded connection for connecting to the top threaded portion 70 (FIG. 3) of the bulb 10. A shade 112*b* fits over each bulb assembly 10, 10*b* and may also contain a threaded connection (not shown) for engaging the top threaded portion 70 of the bulb 10*b*. A pin 116 secures the shade 112*b* to the fixture 104.

Figure 7:
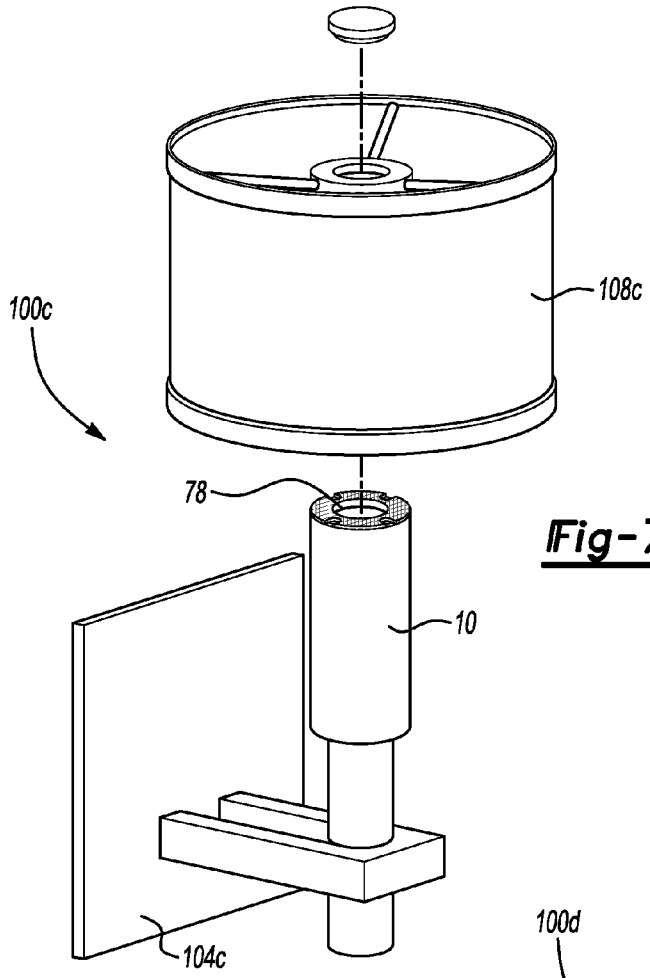
FIG. 7 illustrates yet another example LED lamp assembly.
Figure 8:
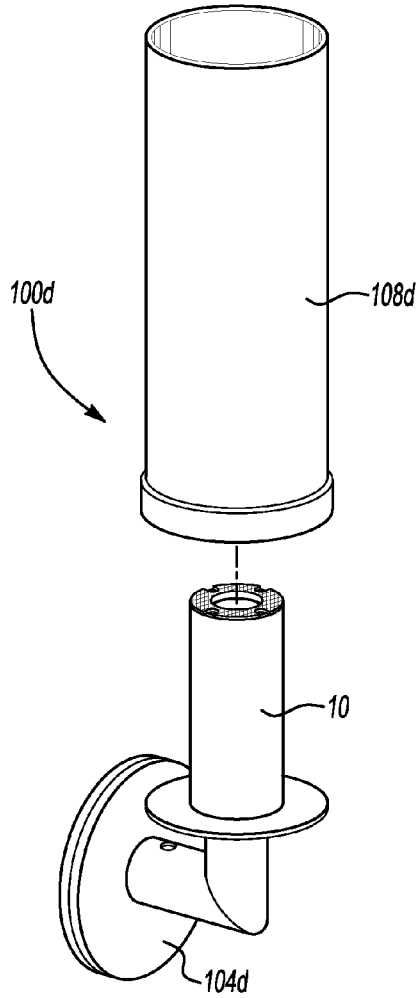
FIG. 8 illustrates yet another example LED lamp assembly.

FIGS. 7 and 8 illustrate two other examples of the lamp assembly 100*c*, 100*d* including the bulb assembly 10 secured to the respective fixture 104*c*, 104*d*. The shades 108 attach typically to the top threaded portion 70 through the lens opening 78. Known methods exist for attaching a shade 108 to a threaded female portion.

Of course, although shown as attaching shades 108*a*-108*d* to the top threaded portion 70 through the lens opening 78, other examples may include attaching a second bulb assembly 10 to the top threaded portion 70. In so doing, the overall length of the bulb assembly 10 increases due to the added bulb assembly 10.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A light emitting diode bulb assembly, comprising:

a base having a first end portion and a second end portion defining an axis;

a plurality of first light emitting diodes secured adjacent a plurality of first base surfaces about said axis; and at least one second light emitting diode secured adjacent a second base surface of said first end portion, wherein said second base surface is transverse to said plurality of first base surfaces, wherein said first end portion includes a first feature for securing said base to one of a fixture or a second bulb assembly and said second end portion includes a second feature for securing said base to the other of said fixture or said second bulb assembly, wherein the first feature and the second feature are both recessed female-type attachment features.

2. The bulb assembly of claim 1, wherein said base is extruded.

3. The bulb assembly of claim 1, including a first lens, wherein at least one of said lens or said first base surface includes a groove for slideably receiving an extension from the other of said lens or said base.

4. The bulb assembly of claim 3, including a second lens mounted transverse to said first lens, said second lens configured to alter light from said at least one second light emitting diode.

5. The bulb assembly of claim 3, including a second lens distinct from said first lens and configured to alter light from said at least one second light emitting diode.

6. The bulb assembly of claim 1, wherein said first feature and said second feature each include a threaded portion.

7. The bulb assembly of claim 1, wherein said first feature and said second feature are each configured to receive a threaded attachment.

8. The bulb assembly of claim 1, wherein said second base surface defines a groove for receiving a fastener that holds at least one of said plurality of first light emitting diodes.

* * * * *